United States Patent [19]

Heseltine

[11] Patent Number: 4,507,341

[45] Date of Patent: Mar. 26, 1985

[54] CARBON FIBRE STRUCTURES

[75] Inventor: Mark J. Heseltine, Crewkerne, England

[73] Assignee: Westland plc, Yeovil, England

[21] Appl. No.: 581,191

[22] Filed: Feb. 17, 1984

[30] Foreign Application Priority Data

Feb. 24, 1983 [GB] United Kingdom ..... 8305161

[51] Int. Cl.[3] ..... H01Q 1/28; H01R 3/00

[52] U.S. Cl. ..... 428/78; 156/285; 156/292; 156/307.7; 156/313; 339/94 M; 339/278 M; 339/10; 343/708; 343/713; 343/846; 428/107; 428/110; 428/113; 428/198; 428/288; 428/295; 428/298; 428/408; 428/457

[58] Field of Search ..... 156/285, 292, 307.7, 156/313; 339/94 M, 278 M, 10; 343/708, 713, 846; 428/78, 107, 110, 113, 198, 288, 295, 298, 408, 457

[56] References Cited

U.S. PATENT DOCUMENTS

| | | | |
|---|---|---|---|
| 3,680,037 | 7/1972 | Nellis et al. | 339/DIG. 3 |
| 3,795,037 | 3/1974 | Luttmer | 339/59 M |
| 3,934,959 | 1/1976 | Gilissen | 339/59 M |
| 3,954,317 | 5/1976 | Gilissen | 339/59 M |
| 4,134,120 | 1/1979 | De Loach | 343/715 |
| 4,199,209 | 4/1980 | Cherian | 339/59 M |

*Primary Examiner*—James C. Cannon

*Attorney, Agent, or Firm*—Larson and Taylor

[57] ABSTRACT

A portion of the surface area of a resin bonded structure comprises an exposed dimpled electrically conductive metal shim bonded to the structure to provide a low electrical impedance connection for mounting a device such as a radio antenna. Preferably, a ply of unidirectional carbon fibres coated with an electrically conductive material such as a uniform and concentric coating of electroplated nickel is located between the shim and the outer carbon fibre layer of the structure with the fibre orientation of the ply of coated carbon fibres at 90 degrees to the carbon fibre layer. The invention also extends to a method of providing a low electrical impedance connection on to a pre-cured resin bonded carbon fibre structure and to a method of attaching a radio antenna on to such a structure.

9 Claims, 6 Drawing Figures

CARBON FIBRE STRUCTURES

Figure 1:
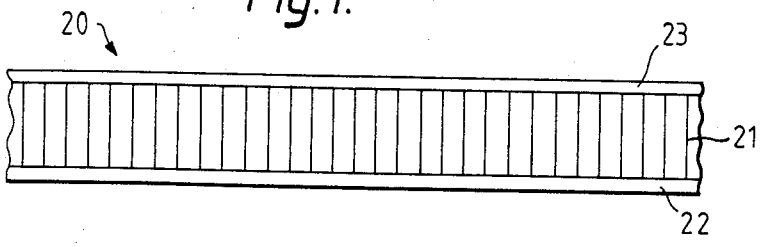

This invention relates to carbon fibre structures and particularly to resin bonded carbon fibre structures having a surface area portion adapted to provide a low electrical impedance connection, and to methods of providing such a connection.

The use of carbon fibre structures, for example, in the manufacture of some structural components of aircraft and helicopters is well established. It has been proposed to extend the use of such composite material to the manufacture of complete fuselage components; however a problem has arisen in providing a low electrical impedance connection on to such a structure because as manufactured such a structure exhibits a minute layer of resin over the surface of the structure, which acts as an electrical insulator.

The problem manifests itself, for example, in the mounting of a radio antenna which requires a good electrical connection in order to inject, through a base connection, high R.F. currents into the fuselage surface which then acts as a ground plane or counterpoise. A poor connection produces heat and lowers the overall efficiency of the system, and the problem is particularly relevant in the H.F. range of radio frequencies (2–30 MHz).

Accordingly, in one aspect the invention provides a resin bonded carbon fibre structure having a portion of its surface area adapted to provide a low electrical impedance connection for mounting a device such as a radio antenna characterised in that said surface area portion comprises an exposed dimpled electrically conductive metal shim bonded to the structure.

The shim may comprise nickel plated brass.

A ply of unidirectional carbon fibres coated with an electrically conductive material may be located between the shim and the outer carbon fibre layer of the structure and, preferably, the fibre orientation in the said ply of coated carbon fibres is at 90 degrees to the fibres of the outer carbon fibre layer. The electrically conductive coating material may constitute a uniform and concentric coating of electroplated nickel.

In another aspect the invention provides a method of providing a low electrical impedance connection on to a pre-cured resin bonded carbon fibre composite structure, comprising the steps of abrading an area of the structure of the desired size and shape so as to remove the external resin layer and expose a layer of carbon fibres, cutting one ply of an electrically conductive pre-impregnated unidirectional fibre material to the shape of the abraded area, applying the electrically conductive fibre material on to the abraded area, so that its fibre orientation is at 90 degrees to the exposed carbon fibres of the structure, cutting a dimpled electrically conductive metal shim to a desired size and shape and locating it over the electrically conductive fibre material with the dimples in engagement therewith, and bonding the electrically conductive fibre material and the shim on to the structure.

In yet another aspect the invention provides a method of attaching a radio antenna on to a resin bonded carbon fibre structure, comprising the steps of cutting antenna attachment holes and apertures for tuning logic and RF input connections through the structure, abrading an area of the outer surface of the structure at least as large as the footprint area of the antenna to remove the resin layer and expose a layer of fibres, cutting a ply of an electrically conductive pre-impregnated unidirectional fibre material to fit the abraded area and applying it to the structure so that the fibre orientation of the conductive material ply is at 90 degrees to that of the exposed carbon fibres, cutting a lightly dimpled electrically conductive metal shim so as to fit the abraded area and locating the shim with its dimples engaging the electrically conductive fibre material, bonding the ply of electrically conductive fibre material and the shim on to the exposed fibre layer, locating an RF gasket and the antenna on the shim and securing the antenna with attachment bolts.

Preferably, the electrically conductive fibre material comprises carbon fibres uniformly and concentrically coated with electroplated nickel, and the metal shim comprises nickel plated brass.

Figure 2:
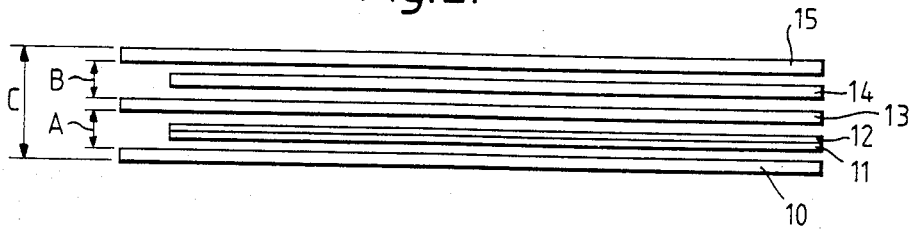
Figure 3:
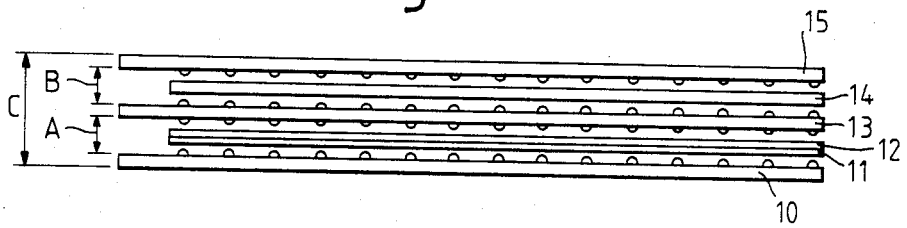
Figure 4:
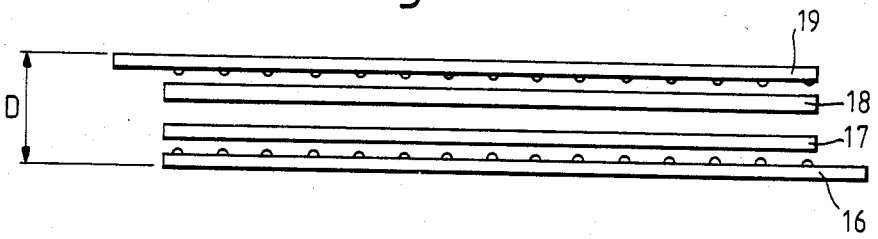
Figure 5:
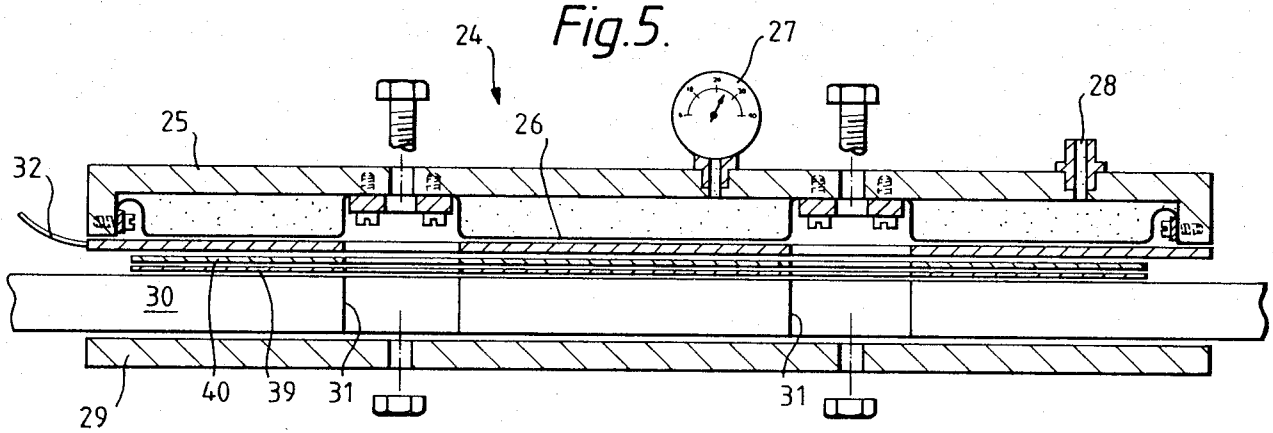
Figure 6:
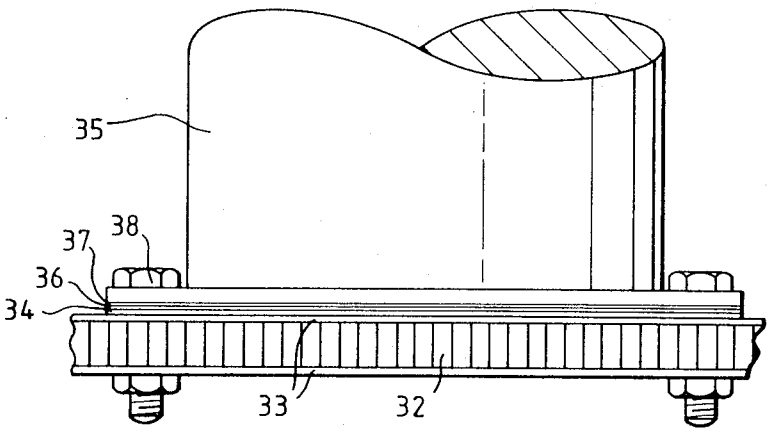

The invention will now be described by way of example only and with reference to the accompanying drawings in which:

FIG. 1 is a side elevation of a typical structural panel constructed using carbon fibre reinforced materials;

FIGS. 2 to 4 inclusive are side elevations of test samples constructed to illustrate various features of the invention;

FIG. 5 is a cross sectional side elevation of apparatus for use in carrying out the invention; and FIG. 6 is a fragmentary cross section of a resin bonded carbon fibre structure constructed in accordance with a preferred embodiment of the invention.

In FIG. 1, a typical fibre reinforced structural panel 20 for use in aircraft construction consists of an aluminium or paper honeycomb core 21 sandwiched between outer sheets 22 and 23 each comprising a plurality of layers of pre-impregnated unidirectional carbon fibres. The structure is consolidated and cured by the application of heat and pressure.

From experience gained in mounting an HF antenna on to a metal skinned aircraft fuselage it is known that for efficient operation a connection resistance between the RF gasket and the fuselage surface should be not greater than about 1 milli-ohm (mΩ). Whilst this is relatively easy to achieve on the metal skin it is considered that an RF gasket bolted on to the resin rich outer surface of the composite panel of FIG. 1 would result in a connection resistance several orders of magnitude higher.

Investigations were therefore put in hand with a view to determining a method of providing a low electrical impedance connection on to a carbon fibre structure.

Each of the test samples of FIGS. 2 to 4 is about 10.16 cm (4.0 in) square and it will be understood that the thickness of the respective layers has been greatly enlarged in the drawings in order to clarify the construction.

SAMPLE 1 (FIG. 2)

Sample 1 consists of a plain sheet of 0.050 mm (0.002 in) thick electrically conductive metal shim 10 such as nickel plated brass, two layers 11 and 12 of 0.127 mm (0.005 in) thick pre-impregnated unidirectional carbon fibre material arranged at 90 degrees to each other, a second plain nickel plated brass shim 13, a single layer 14 of 0.127 mm (0.005 in) thick pre-impregnated unidirectional carbon fibre material and a third plain nickel plated brass shim 15.

The assembly was then cured at a temperature of 248° F. (120° C.) for one hour and at a consolidating pressure of 1.75 kg/sq cm (25 psi).

The electrical resistances at A, B and C of FIG. 1 were measured and are shown in Table 1, the values being in milli-ohms (mΩ).

SAMPLE 2 (FIG. 3)

Sample 2 was identical to Sample 1 except that the sheets 10, 13 and 15 of electrically conductive metal shim were lightly dimpled nickel plated brass shim. Sheets 10 and 15 were dimpled from one side only and arranged with the dimples protruding into the adjacent carbon fibre layer and sheet 13 was dimpled from both sides.

The measured height of the dimples from the surface of the sheet was approximately 0.050 mm (0.002 in) with a spacing of approximately 2.54 mm (0.1 in).

The resistances at A, B and C were again measured and are recorded in milli-ohms in Table 1.

It will be noted that the resistances of Sample 2 show a significant reduction over those of Sample 1 indicating that the protrusion of the dimples into the adjacent carbon fibre layers provides a useful improvement in the electrical continuity. The increase in resistance at A in both cases is clearly attributable to the extra layer of carbon fibre material between shims 10 and 13.

TABLE 1

| | Resistance (mΩ) | |
|---|---|---|
| | Sample 1 | Sample 2 |
| A | 29.7 | 19.2 |
| B | 11.9 | 6.7 |
| C | 40.7 | 25.0 |

The above tests illustrated that the use of a lightly dimpled electrically conductive metal shim such as nickel plated brass would considerably reduce the electrical resistance of a connection on to a carbon fibre surface and, in itself, will be of useful benefit in some applications. However, Samples 2 and 3 were cured as an assembly and it was thought necessary also to investigate the most beneficial way of providing a low electrical impedance on to a pre-cured structure and, if possible, to provide a yet further reduction in electrical resistance.

SAMPLE 3 (FIG. 4)

Sample 3 consisted of a lower dimpled nickel plated brass shim 16 on to which one layer 17 of 0.127 mm (0.005 in) thick pre-impregnated unidirectional carbon fibre material was bonded under a consolidating pressure of 1.75 kg/sq cm (25 psi) at a temperature of 284° F. (140° C.) for one hour. After curing, the outer surface of layer 17 was abraded using wet and dry paper to remove the layer of cured resin and expose the carbon fibres.

A layer of electrically conductive fibre reinforced material 18 comprising a further layer of 0.127 mm (0.005 in) thick pre-impregnated unidirectional carbon fibre reinforced material was then laid on to the exposed fibres of layer 17 with the direction of its fibres at 90 degrees to those of layer 17. It was considered that this orientation of fibres would provide for improved electrical contact under a consolidation pressure.

Layer 18 was covered by a further dimpled nickel plated brass shim 19 and bonded to the pre-cured layer 17 at a temperature of 350° F. (177° C.) and a consolidation pressure of 1.75 kg/sq cm (25 psi) for 2 hours. It will be understood that bonding is achieved by curing of the impregnating resin in layer 18.

The electrical resistance across the shims 16 and 19 identified at D in FIG. 4 was measured and is shown in Table 2.

SAMPLE 4

Sample 4 was identical to Sample 3 except that layer 18 was replaced by an electrically conductive layer comprising a pre-impregnated unidirectional layer in which the carbon fibres had been uniformly and concentrically coated with an electrically conductive material such as electroplated nickel. Such material is available under the Trade Name CYMET from Cyanamid Fothergill, and it will be understood again that bonding is achieved by using the impregnating resin. The electrical resistance at D was measured and is shown in Table 2.

SAMPLE 5

Sample 5 was identical to Sample 4 except that the components were co-cured, i.e. the assembly was cured in a single curing operation, so as to be representative of a mounting incorporated during manufacture of a carbon fibre panel. The electrical resistance at D is again shown in Table 2.

TABLE 2

| | Electrical Resistance (mΩ) | | |
|---|---|---|---|
| | Sample 3 | Sample 4 | Sample 5 |
| D | 11.6 | 5.4 | 5.8 |

Thus it will be noted that the resistance in Samples 4 and 5 using the nickel plated fibre material is about one half of the resistance of Sample 3 in which the electrically conductive layer comprised a layer of conventional pre-impregnated unidirectional carbon fibres.

Having demonstrated the improvement in electrical continuity of Samples 4 and 5 it was necessary to determine whether or not such a construction in an aircraft panel would achieve a sufficiently low connection resistance to enable successful mounting of an HF antenna. Thus it is to be remembered that the electrical resistances of 5.4 and 5.8 mΩ (Samples 4 and 5) are the cumulative value of:

1. the through thickness resistance of the dimpled shim 19,
2. the contact resistance between the shim 19 and the electrically conductive layer 18,
3. the through thickness resistance of the electrically conductive layer 18,
4. the contact resistance between the electrically conductive layer and the abraded carbon fibre layer 17,
5. the through thickness resistance of the carbon fibre layer 17,
6. the contact resistance between the carbon fibre layer 17 and the shim 16,
7. the through thickness resistance of the dimpled shim 16.

However, from the results of the test samples hereinbefore described it was clear that the most promising assembly was that of Samples 4 and 5 which consisted of a layer of electrically conductive fibre material 18 superimposed by a dimpled shim 19. Thus the resistance that it was necessary to determine was the connection resistance of these components when assembled on to the carbon fibre layer 17 i.e. the sum of the resistances itemised above as 1 to 4 inclusive.

In respect of item 7 above, the nickel plated brass shim can, when compared to the carbon fibre panel, be considered a perfect conductor and therefore ignored.

Consider first the case of the pre-cured panel of Sample 4. It is known that the resistivity $\rho$ of a well consolidated carbon fibre layer is $15\times10^{-3}$ Ωm so that the resistance R of one ply measuring 0.1016×0.1016 m×0.127 mm thick (4.0 in×4.0 in×0.005 in thick) is given by the formula $$R = \frac{\rho l}{A}$$

$$= \frac{15 \times 10^{-3} \times 0.127 \times 10^{-3}}{0.1016^2}$$

$$= 0.186 \text{ m } \Omega \text{(item 5 above)}$$

From Sample 2 value B, the contact resistance of a shim to the carbon fibre layer $$= \frac{6.7 - 0.186}{2}$$

$$= 3.26 \text{ m } \Omega \text{(item 6 above)}$$

Therefore, one ply of carbon fibre material bonded to a shim would have a resistance of 0.186+3.26mΩ=3.45mΩ.

Subtracting this value from value D of Sample 4, i.e. 5.4−3.45 provides a collective resistance that is the sum of the resistances of items 1 to 4 inclusive, so that the connection resistance for a panel 0.1016m (40 in) square, i.e. having a cross secitonal area of 10322 sq mm (16 sq in) equals 1.95 mΩ.

This value must now be extrapolated to the area of an HF antenna base. For this purpose a particular type of antenna previously widely used in helicopters and having a base or footprint area of 27742 mm² (43 in²) was selected.

Thus the connection resistance of 1 mm² (0.001 in²) is given by $$1/1.95 = 10322/R_1$$

whereby $R_1$=20128 mΩ/mm² (31.2 mΩ/in²). Therefore the connection resistance for the particular antenna being considered is given by $$R_{HF}^1 = 27742/20128$$

and $$R_{HF} = 0.73 \text{ m}\Omega.$$

It will be noted that this value is below the value of 1 mΩ previously mentioned and indicates therefore that the HF antenna can be successfully mounted on pre-cured carbon fibre fuselage panels as would be the case either in installing the antenna after production of the panels or as an in the field procedure.

Consider now the case in which it is desired to provide the antenna mounting during production of the carbon fibre panel.

This case has hereinbefore been identified by Sample 5 which was identical to Sample 4 except that the components were co-cured, i.e. were all cured in one curing cycle.

As before the resistance of one ply of carbon fibre material bonded to a shim is 3.45 mΩ. The resistance D of Sample 5 (Table 2) is known to be 5.8 mΩ so that the connection resistance of the antenna shim and electrically conductive layer is $$5.8 - 3.45 = 2.35 \text{ m}\Omega.$$

Thus the connection resistance of 1 mm² (0.001 in²) is given by $$1/2.35 = 10322/R_1$$

whereby $R_1$=24257 mΩ/mm² (37.6 mΩ/in²).

Therefore, extrapolating for the same antenna base area of 27742 mm² (43 in²) provides $$1/R_{HF} = 27742/24257$$

whereby $$R_{HF} = 0.87 \text{ m}\Omega.$$

Again it will be noted that this value of connection resistance is below the value of 1 mΩ.

It has therefore been demonstrated that the method of this invention is capable of providing an electrical connection on to a carbon fibre panel whose resistance is comparable with that normally achieved on a metallic fuselage. It has also been shown that the method is applicable to carbon fibre structures both during the manufacturing stage as well as to panels that have previously been cured.

In putting the present invention into effect it was clear that two cases in the provision of a low electrical impedance connections on to a carbon fibre structure needed to be considered. Thus, firstly it was necessary to consider the procedure to be applied during manufacture of the structure and secondly to consider the procedure in the case of a pre-cured structure.

Depending on the degree of electrical continuity required and bearing in mind the above test results, one of the following procedures should be applied in the manufacture of a structure having an outer skin comprised of a plurality of layers of pre-impregnated unidirectional carbon fibres.

Procedure 1

Cut a lightly dimpled electrically conductive metal shim to a selected size and shape that will be for example at least as large as the footprint area of a device such as a radio antenna which is to be subsequently connected to the structure. After laying up the carbon fibre layers, locate the shim in the desired location and cure the structure by the application of heat and pressure in the normal manner.

Procedure 2

This procedure is similar to procedure 1 except that the outermost fibre layer at least in the area of the shim consists of pre-impregnated unidirectional fibre material in which the fibres are electrically conductive e.g. carbon, and are coated with a uniform and concentric layer of electrically conductive material e.g. electroplated nickel. The fibres of the electrically conductive layer are located at 90 degrees to the fibres of the carbon fibre layer which it contacts. The mounting is completed by a electrically conductive metal shim.

Coming now to the second case of a pre-cured panel one of the following procedures should be applied.

Procedure 3

Abrade an area of the outer surface of the structure of the desired size and shape so as to remove the cured resin layer and expose the carbon fibres. Cut one layer of a pre-impregnated unidirectional fibre material in which the fibres are electrically conductive e.g. carbon, or in which the fibres are electrically conductive and coated with a uniform and concentric layer of electrically conductive material, to a desired size and shape and so that its fibre orientation is at 90 degrees to the exposed carbon fibres, and lay up on the abraded area. Cut a lightly dimpled electrically conductive metal shim to a corresponding size and shape and locate over the fibre layer with its dimples engaging the electrically conductive fibre material.

Bond the electrically conductive fibre material and the shim to the structure using heat and pressure.

The invention also extends to a method of either incorporating a low impedance connection or repairing an existing connection on a carbon fibre structure in the field, and for this purpose a portable membrane box and heater mat is proposed (FIG. 5).

The box 24 comprises a metal frame 25 carrying a flexible rubber membrane 26 and incorporating a pressure gauge 27 and compressed air inlet connection 28. A load spreader plate 29 is located on the opposite side of the structure 30 and the box 24 is secured by bolts passing through apertures 31 formed through the structure either for attachment bolts for the device to be mounted on the structure or in the case of an HF antenna, for tuning logic and RF input connection. The procedure is similar to that of procedure 3, i.e. a layer of pre-impregnated electrically conductive fibre material 39 followed by a dimpled electrically conductive metal shim 40 is laid up on the abraded area of the structure 30. A heater mat 32 interposed between the dimpled shim 20 and the membrane, energisation of the heater mat 32 providing the temperature required for curing the resin of the electrically conductive fibre layer to bond the shim in position under the consolidating pressure supplied by inflating the membrane 26.

FIG. 6 illustrates a resin bonded carbon fibre structure having a portion of its surface area prepared in accordance with one of the methods hereinbefore described in order to provide a low electrical impedance connection, and in use in a practical installation for the attachment of a radio antenna.

The structure comprises a sandwich of honeycomb material 32 between skins 33 each consisting of a plurality of layers of resin bonded carbon fibres. A ply of pre-impregnated electrically conductive carbon fibres 34 of approximately the same dimensions as the footprint area of an antenna 35 followed by a lightly dimpled electrically conductive metal shim 36 of similar size and with its dimples engaging the electrically conductive fibre layer, are bonded to the external surface of one of the skins 33. A conventional RF gasket 37 is located on the shim and the antenna 35 is attached to the structure by bolts 38 through an integral flange portion. It will be understood that the thickness of the various layers illustrated in FIG. 6 are exaggerated in the interests of clarity.

What is claimed is:

1. A resin bonded carbon fibre structure having a portion of its surface area adapted to provide a low electrical impedance connection for mounting a device such as a radio antenna, characterised in that said surface area portion comprises an exposed dimpled electrically conductive metal shim bonded to the structure.

2. A structure as claimed in claim 1, wherein said metal shim comprises nickel-plated brass.

3. A structure as claimed in claim 1 and including a ply of unidirectional carbon fibres coated with an electrically conductive material located between the said shim and the outer carbon fibre layer of the structure.

4. A structure as claimed in claim 3, wherein the fibre-orientation in the said ply of coated carbon fibres is at 90 degrees to the fibres of the outer carbon fibre layer.

5. A structure as claimed in claim 3, wherein the electrically conductive coating material constitutes a uniform and concentric coating of electro-plated nickel.

6. A method of providing a low electrical impedance connection on to a pre-cured resin bonded carbon fibre structure, characterised by the steps of abrading an area of the structure of the desired size and shape so as to remove the external resin layer and expose a layer of carbon fibres, cutting one ply of an electrically conductive pre-impregnated unidirectional fibre material to the shape of the abraded area, applying the electrically conductive fibre material on to abraded area so that its fibre orientation is at 90 degrees to the exposed carbon fibres of the structure, cutting a dimpled electrically conductive metal shim to a desired size and shape and locating it over the electrically conductive fibre material with the dimples in engagement therewith, and bonding the electrically conductive fibre material and the shim on to the structure.

7. A method as claimed in claim 6, wherein the electrically conductive fibre material comprises carbon fibres uniformly and concentrically coated with electroplated nickel.

8. A method as claimed in claim 6, wherein said metal shim comprises nickel-plated brass.

9. A method of attaching a radio antenna on to a resin bonded carbon fibre structure, characterised by the steps of cutting antenna attachment holes and apertures for tuning logic and RF input connections through the structure, abrading an area of the outer surface of the structure at least as large as the footprint area of the antenna to remove the resin layer and expose a layer of fibres, cutting a ply of an electrically conductive pre-impregnated unidirectional fibre material to fit the abraded area and applying it to the structure so that the fibre orientation of the conductive material ply is at 90 degrees to that of the exposed carbon fibres, cutting a dimpled electrically conductive metal shim so as to fit the abraded area and locating the shim with its dimples engaging the electrically conductive fibre material, bonding the ply of electrically conductive fibre materials and the shim on to the exposed fibre layer, locating an RF gasket and the antenna on the shim and securing the antenna with attachment bolts.

* * * * *